US008109040B2

(12) United States Patent
Finke

(10) Patent No.: US 8,109,040 B2
(45) Date of Patent: Feb. 7, 2012

(54) LINEAR DRIVE ARRANGEMENT FOR A SLIDING DOOR

(75) Inventor: Andreas Finke, Gevelsberg (DE)

(73) Assignee: Dorma GmbH + Co. KG, Ennepetal (DE)

( * ) Notice: Subject to any disclaimer, the term of this patent is extended or adjusted under 35 U.S.C. 154(b) by 219 days.

(21) Appl. No.: 10/520,494

(22) PCT Filed: Dec. 8, 2003

(86) PCT No.: PCT/EP03/13872

§ 371 (c)(1),
(2), (4) Date: Jan. 7, 2005

(87) PCT Pub. No.: WO2004/053266

PCT Pub. Date: Jun. 24, 2004

(65) Prior Publication Data

US 2005/0235567 A1 Oct. 27, 2005

(30) Foreign Application Priority Data

Dec. 9, 2002 (DE) ..... 102 57 582

(51) Int. Cl.
*E05F 15/06* (2006.01)

(52) U.S. Cl. ..... 49/360; 49/409; 49/404

(58) Field of Classification Search ..... 049/409, 049/404, 425, 426, 360; 16/105
See application file for complete search history.

(56) References Cited

U.S. PATENT DOCUMENTS 1,881,015 A * 10/1932 Ayers ..... 49/360
1,986,616 A * 1/1935 Baldwin ..... 310/13
2,303,263 A * 11/1942 Fisher ..... 310/14
2,337,430 A * 12/1943 Trombetta ..... 310/13
2,627,633 A * 2/1953 Shectman ..... 52/801.1
3,105,272 A * 10/1963 Tucker, Jr. ..... 49/411
3,329,993 A * 7/1967 Anderson ..... 16/105
3,621,349 A * 11/1971 Reyx ..... 318/138
4,019,786 A 4/1977 Yarris
4,324,185 A * 4/1982 Vinson ..... 104/283
4,624,617 A * 11/1986 Belna ..... 414/347
4,653,127 A * 3/1987 Baus ..... 4/610
4,876,765 A * 10/1989 Karita ..... 16/102
5,070,575 A * 12/1991 Redman et al. ..... 16/96 R
5,134,324 A * 7/1992 Sakagami et al. ..... 310/12.04
5,172,518 A * 12/1992 Yoshino ..... 49/360
5,495,918 A * 3/1996 Peruggi et al. ..... 187/316
5,712,516 A 1/1998 Kabout
5,736,693 A * 4/1998 Piech et al. ..... 187/316
6,289,643 B1 9/2001 Bonar (Continued)

FOREIGN PATENT DOCUMENTS

CA 2329664 10/2000

(Continued)

*Primary Examiner* — Gregory J. Strimbu

(74) *Attorney, Agent, or Firm* — Cozen O'Connor

(57) ABSTRACT

A linear drive arrangement for a sliding door includes a guide track, a stator arrangement which is fixed with respect to the guide track, a guide carriage to which a door leaf can be fixed for movement parallel to the guide track, and a plurality of permanent magnets fixed to the carriage so that the carriage can be suspended by magnetic forces between the stator and the magnets. A pair of supporting rollers support the carriage on the guide track when the carriage is not fully suspended by the magnetic forces, particularly at the beginning and end of movement of the carriage.

15 Claims, 19 Drawing Sheets

U.S. PATENT DOCUMENTS

| | | | | |
|---|---|---|---|---|
| 6,357,359 | B1 * | 3/2002 | Davey et al. | 104/282 |
| 6,449,905 | B2 | 9/2002 | Maki | |
| 7,013,605 | B2 * | 3/2006 | Zhou et al. | 52/30 |

FOREIGN PATENT DOCUMENTS

| | | | |
|---|---|---|---|
| EP | 1 122 391 | | 8/2001 |
| GB | 990 057 | A | 4/1965 |
| GB | 990057 | | 4/1965 |
| JP | 2002-209371 | * | 7/2002 |
| WO | WO 00/50719 | | 8/2000 |

* cited by examiner

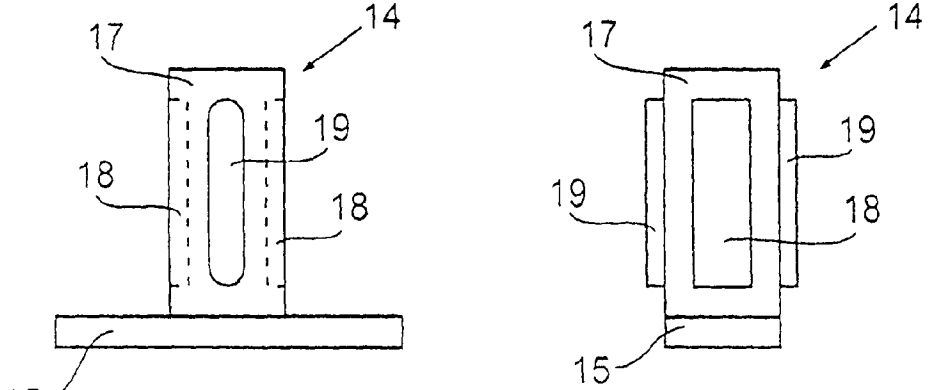
Fig. 4
Fig. 5
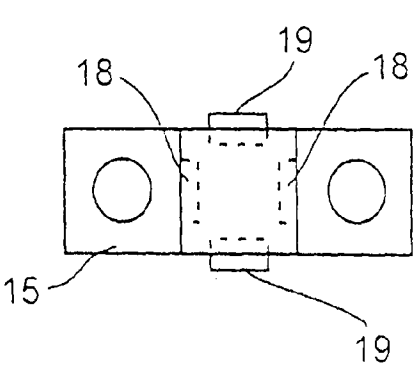
Fig. 6
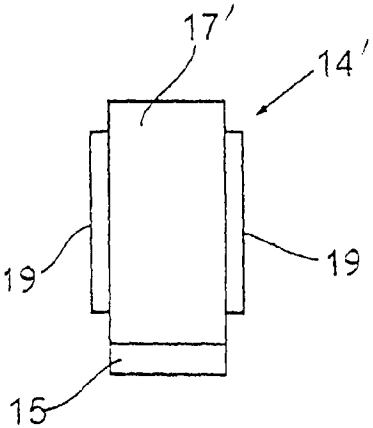
Fig.7
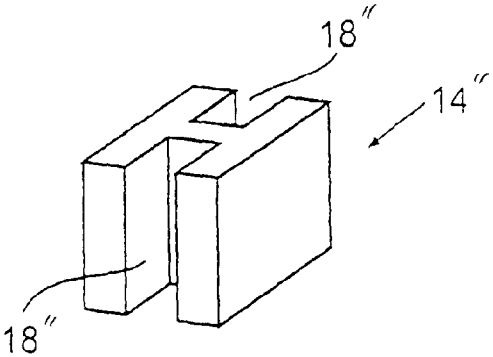
Fig. 8

LINEAR DRIVE ARRANGEMENT FOR A SLIDING DOOR

PRIORITY CLAIM

This is a U.S. national stage of application No. PCT/EP2003/013872, filed on 8 Dec. 2003. Priority under 35 U.S.C. §119(a) and 35 U.S.C. §365(b) is claimed from German Application No. 102 57 582.7, filed 9 Dec. 2002.

BACKGROUND OF THE INVENTION

1. Field of the Invention

The invention is directed to a stabilizing arrangement for a guide carriage, particularly for a sliding door or the like which is movable by a linear drive, wherein the sliding leaf is suspended by magnetic forces.

2. Description of the Related Art

A common problem in sliding doors that are moved by a linear drive consists in that the sliding door executes a shaking or rocking motion when starting and when braking similar to a motor vehicle during acceleration and braking. This rocking motion occurs when starting due to the inertial forces of the door leaf and the acceleration forces of the stationary stator of the linear drive. The acceleration forces tend to displace the leaf laterally and the inertial forces oppose this tendency. This process takes place in an analogous way in reverse when braking. A special situation arises when the door leaf must reverse due to an obstruction. This impairs normal operation of the sliding door.

U.S. Pat. No. 5,712,516 describes a linear drive for a sliding door. In this drive, a stationary long-stator is located above the movable leaf. The individual coils are distributed along the entire length of the stator, namely, in an equally spaced manner. The yoke of the stator comprises bars disposed transverse to a longitudinally arranged yoke part. The side of the transversely arranged yoke segments that faces the leaf is connected by a ferromagnetic plate to spacer strips arranged thereon. Permanent magnets are located on the movable leaf. When the movable leaf is fixed to the plate described above, the leaf is suspended at the stator due to the magnetic force of the permanent magnets. Due to the presence of spacer rollers at the end and at the beginning of the displaceable leaf, there is a defined air gap between the permanent magnets and the spacer strips or plate. When current is supplied to the coils, the magnetic field thereby generated inside the stator is advanced so that the suspended door can continue moving.

SUMMARY OF THE INVENTION

Therefore, it is the object of the present invention to provide a stabilizing arrangement which prevents the rocking motion of the sliding door, particularly when starting and braking.

The rocking motion occurring just at the start and end of the movement process of the sliding door can be reliably prevented by providing the guide carriage with at least one supporting roller which is supported at least at times on a guide track.

According to an advantageous embodiment form, a supporting roller is provided, respectively, in the front end area and rear end area of the guide carriage in order to achieve the most efficient possible stabilization of the sliding door.

The two supporting rollers are preferably arranged on the same side of the guide carriage. This has the advantage that the two supporting rollers can roll on the same guide track.

According to an advantageous further development, the supporting rollers have a bearing shaft which penetrates the guide carriage in a bore hole in order to arrange the supporting rollers so as to be accurately positioned at the guide carriage.

To enable an exact adjustment of the guide roller with respect to the guide track and so that the guide roller rolls on the guide track with as little friction as possible, a freely rotatable roller running on the guide track is arranged, according to the invention, at one end of the bearing shaft eccentric to the shaft axis.

According to an advantageous embodiment form, a thread serving to receive a fastening screw is arranged at the end of the bearing shaft opposite to the roller for a reliable fastening of the bearing shaft. In this way, the bearing shaft can engage through the guide carriage so that the guide carriage can be guided with precision and without play.

According to an advantageous further development, the roller is detachably arranged at the bearing shaft so that the roller can easily be exchanged in case of wear.

To permanently prevent a rocking motion of the sliding door by means of a permanent support of the guide rail at the guide track, it can be provided according to the invention that the roller rolls on the guide track during the entire movement process of the sliding door.

However, if the entire movement of the guide carriage should take place with as little friction as possible, the roller, according to an alternative embodiment form, can also have a slight distance from the guide track and can roll on the guide track only during the start phase and end phase of the movement process of the sliding door. The slight distance can be compensated by a slight rocking motion of the sliding door. Depending upon the selected distance, even a barely perceptible rocking motion can be sufficient to overcome the distance.

BRIEF DESCRIPTION OF THE DRAWINGS

FIG. 4 is a front view of the holder of FIG. 3;

FIG. 5 is a side view of the holder of FIG. 3;

FIG. 6 is a top view of the holder of FIG. 3;

FIG. 7 shows a construction variant of the holder;

FIG. 8 shows another construction variant of the holder;

DETAILED DESCRIPTION OF THE PRESENTLY PREFERRED EMBODIMENTS

Figure 1:
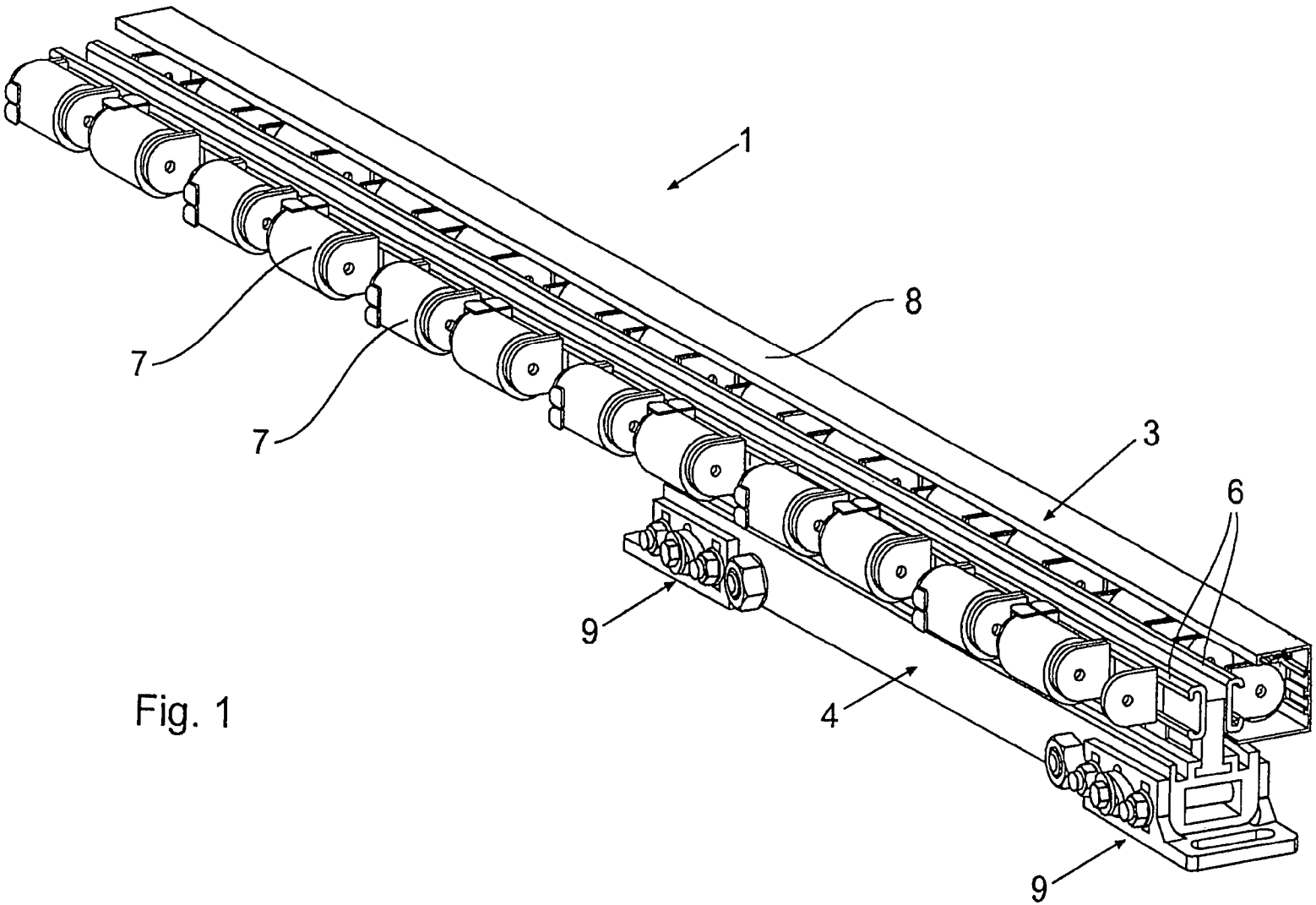
FIG. 1 shows an overall view of a linear drive according to the invention.

FIG. 1 shows an overall view of a linear drive 1 according to the invention. The linear drive 1 is accommodated in a holder 2 (see FIG. 23) which can be fastened to a building part (not shown). The linear drive 1 itself comprises a stationary guide rail 3 mounted in the holder 2 and a guide carriage 4 which is displaceable in the guide rail 3. A sliding door 5 (see FIG. 10) which is movable in longitudinal direction of the guide rail 3 is mounted at the guide carriage 4. The guide carriage 4 is shown in detail in FIG. 2.

Figure 22:
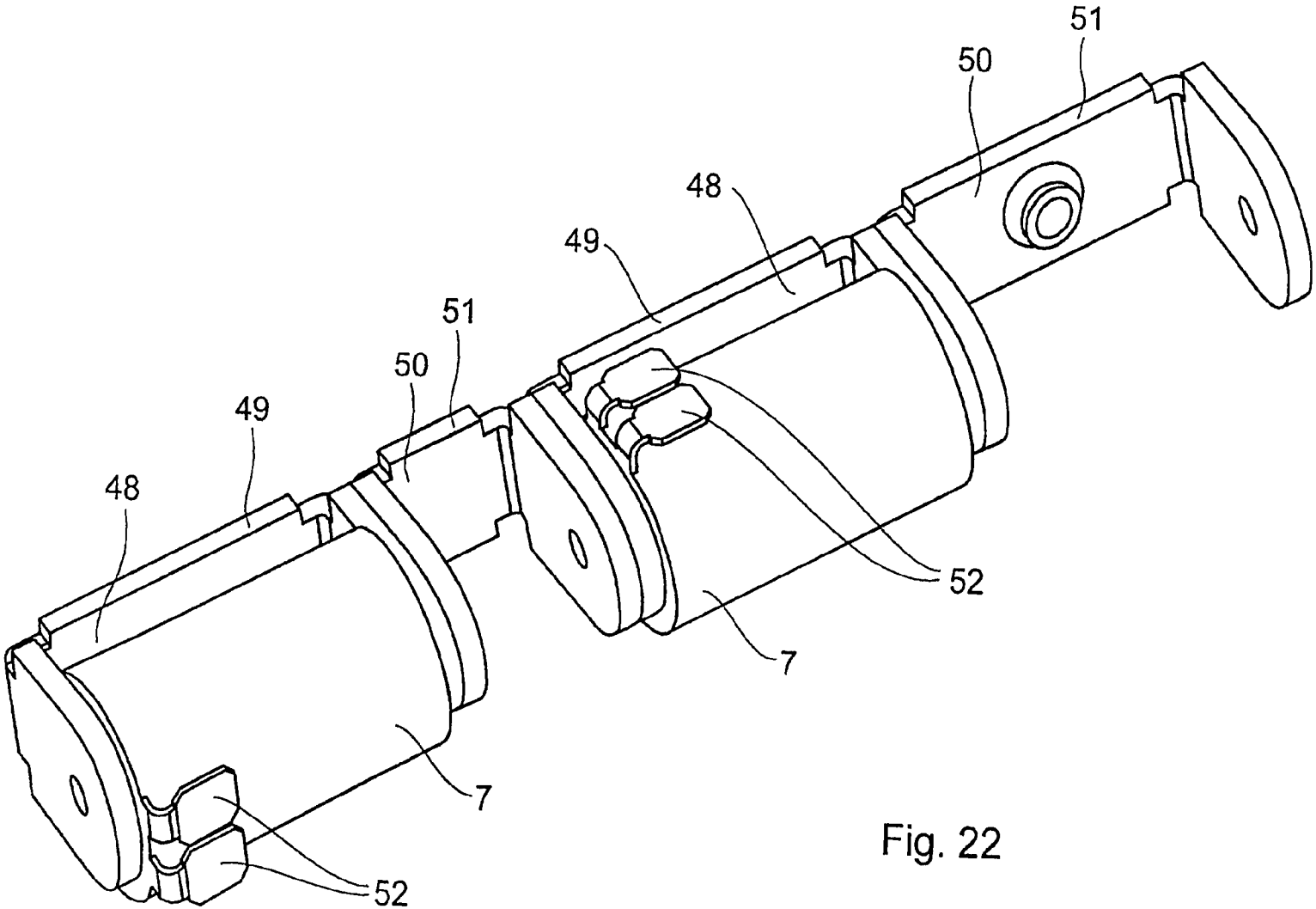
FIG. 22 shows an embodiment form of the coils used in the linear drive according to the invention.

The guide rail 3 has C-shaped slide rails 6 which are spaced apart with their open sides facing away from one another. A portion of the guide carriage 4 is located between the slide rails 6. Coils 7 are arranged in the oppositely facing open sides of the C-shaped slide rails 6 and can be inserted therein from the end sides of the slide rails 6. The coils 7, shown in detail in FIG. 22, are connected to a contact rail 8. Further, an aligning device 9 is provided at the guide carriage 4; the sliding door 5 connected to the guide carriage 4 can be aligned by means of this aligning device 9.

Figure 2:
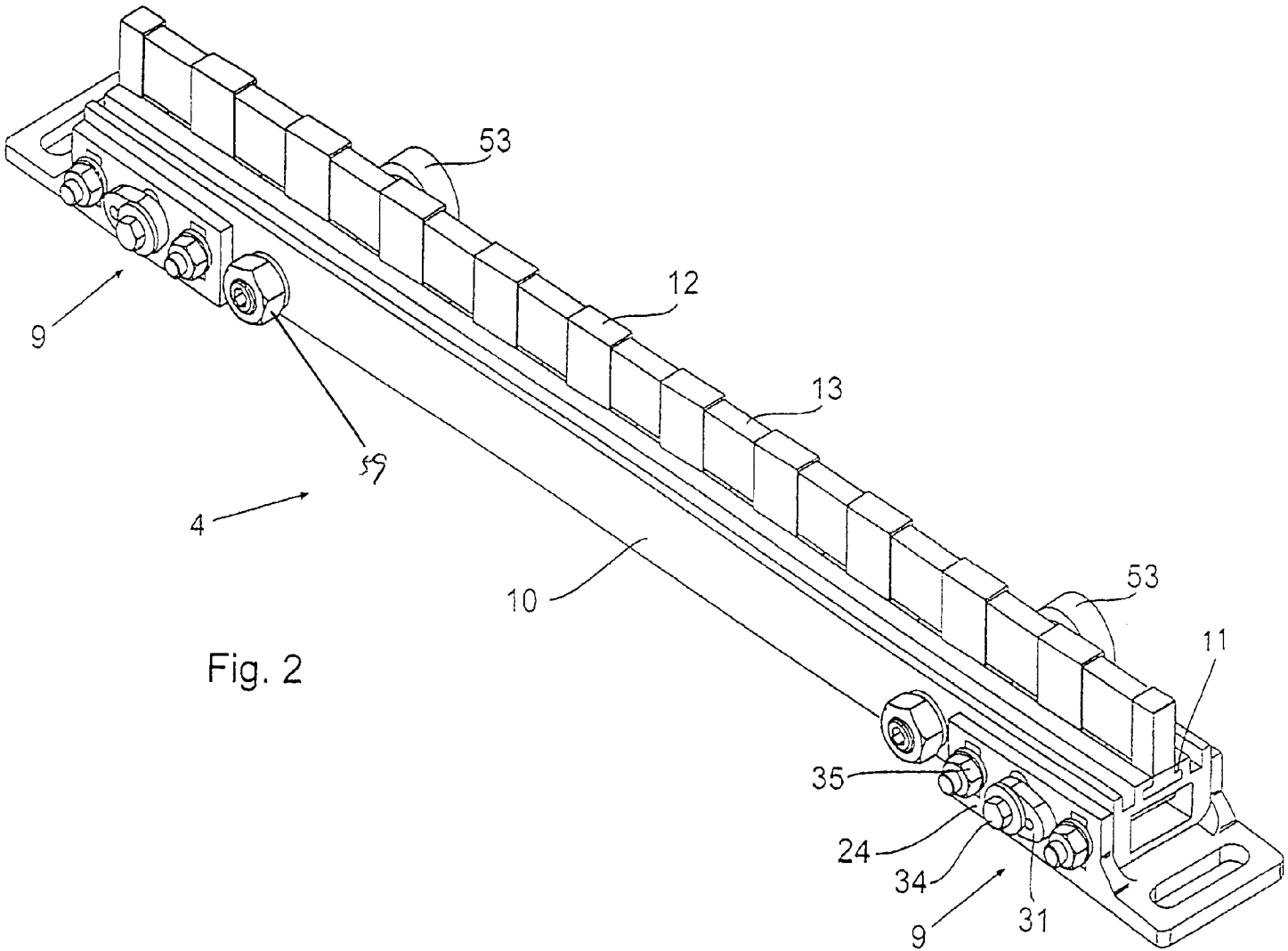
FIG. 2 shows a guide carriage used in combination with the linear drive according to the invention for the suspension of a sliding door.
Figure 14:
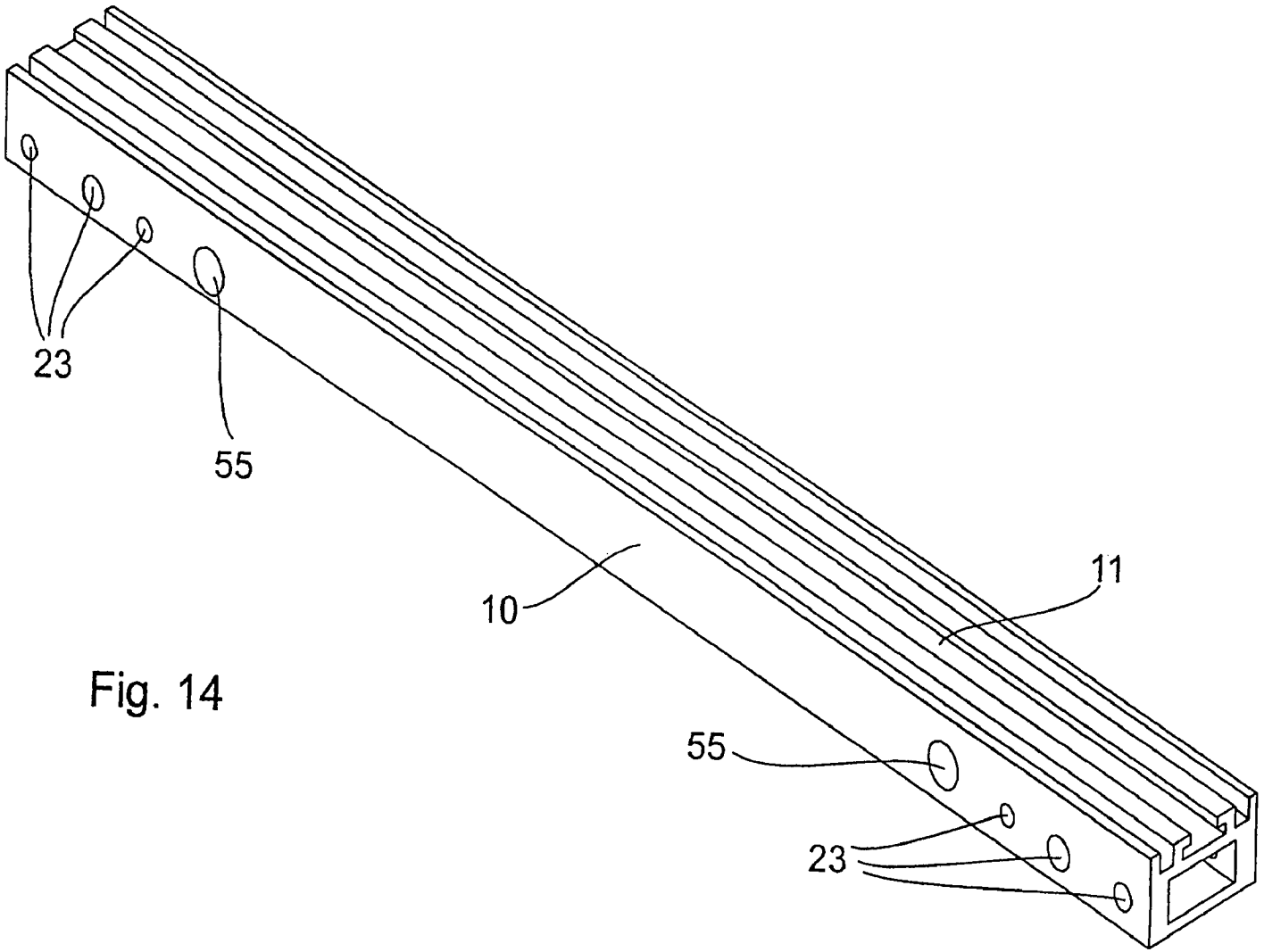
FIG. 14 shows a supporting rail used in connection with the linear drive according to the invention.
Figure 15:
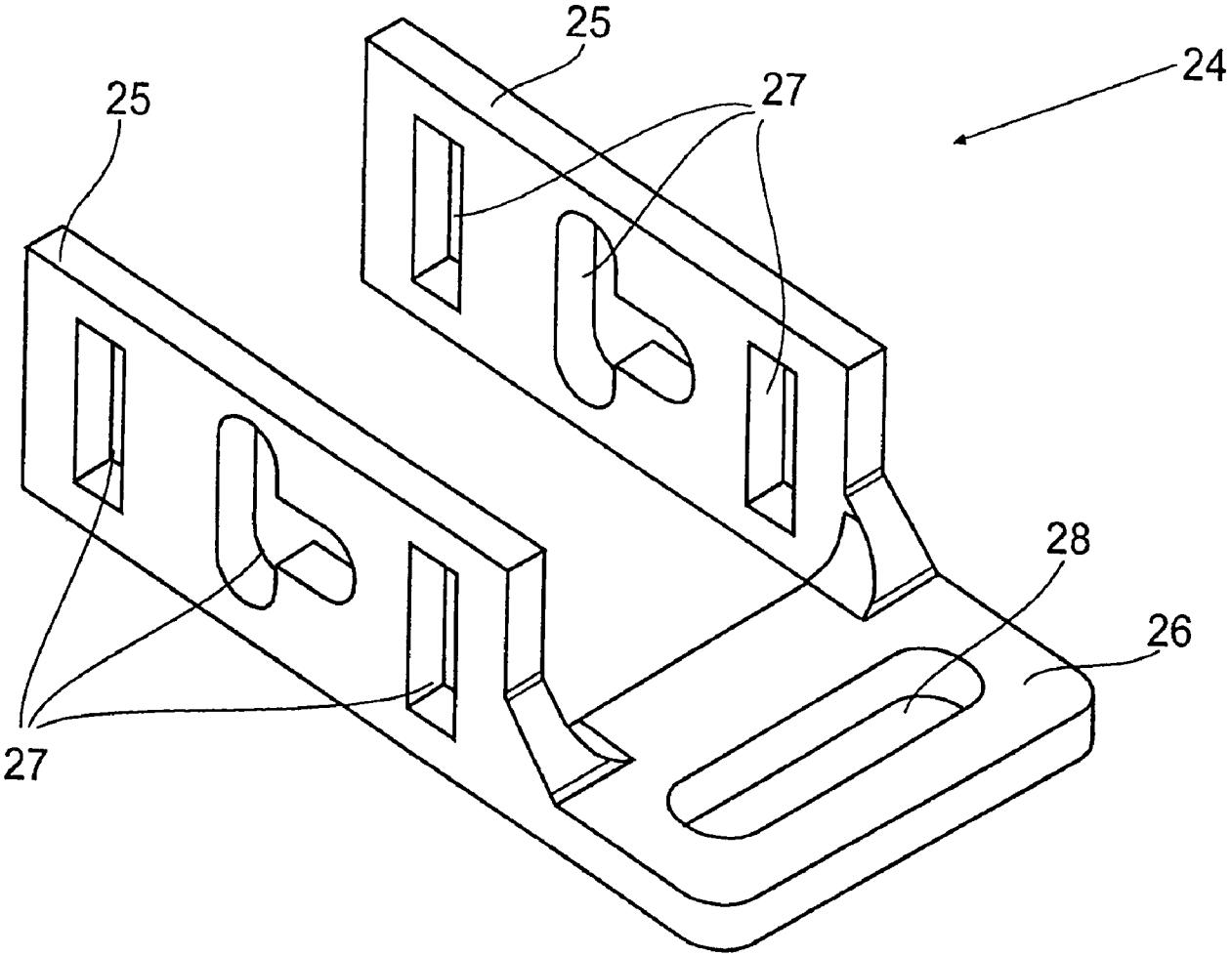
FIG. 15 is a perspective view of a shoe of a first embodiment of an aligning device for a sliding door.
Figure 16:
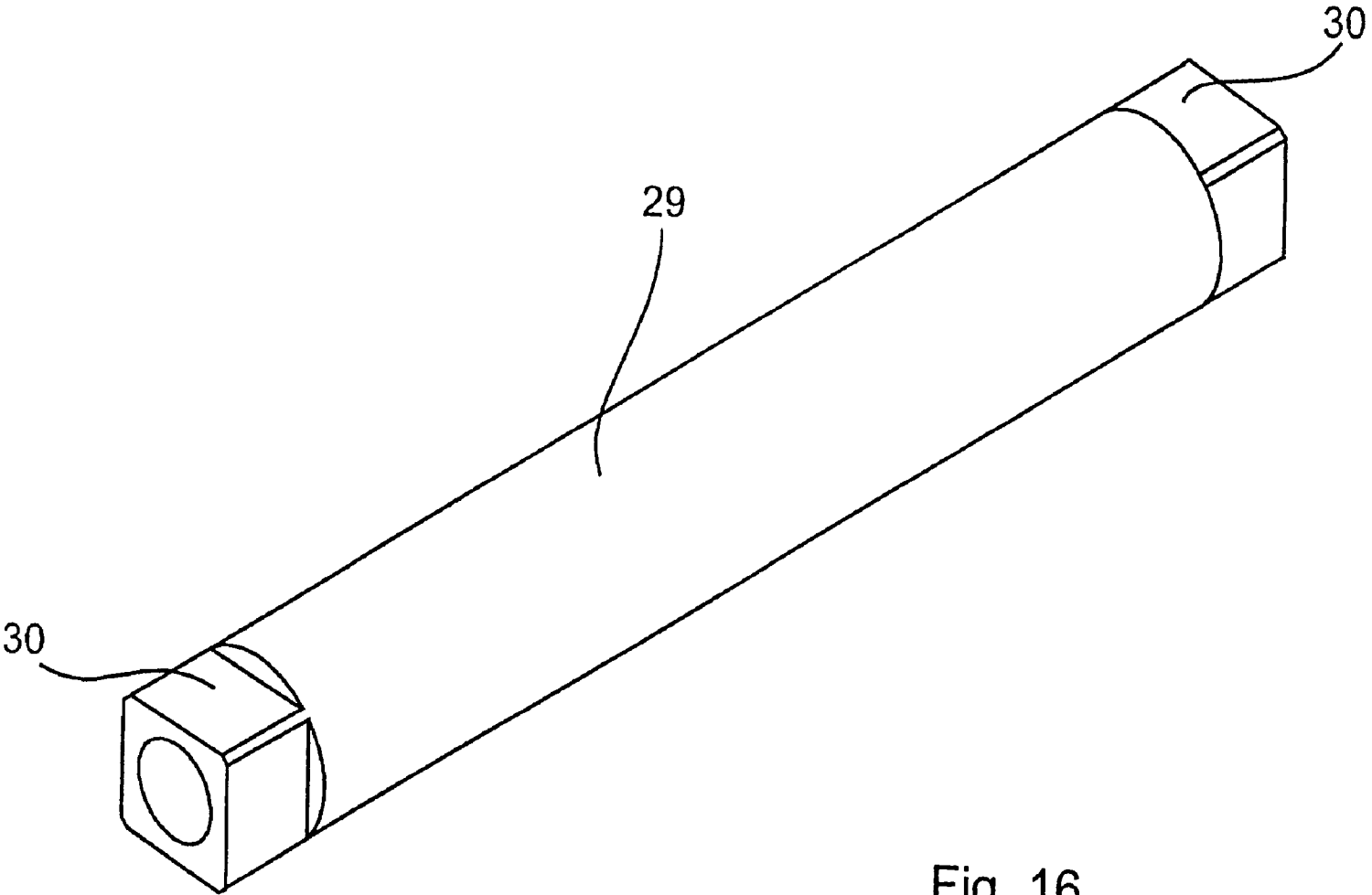
FIG. 16 is a perspective view of a shaft of the first embodiment of the aligning device.

FIG. 2 shows the guide carriage 4 in detail. The guide carriage 4 has a supporting rail 10 which is formed as a hollow box section. A C-shaped channel 11 (see FIG. 14) which extends centrally in longitudinal direction of the supporting rail 10 and opens upward is formed on the upper side of the hollow box section. A holding member 12 which can be inserted into the supporting rail 10 from the end side can be inserted in this channel 11. Magnets 13 are received in this holding member 12 and, together with the coils 7 mounted at the C-shaped slide rails 6, form a holder and a drive for the sliding door 5. The construction of the holding member 12 is described more fully in connection with FIGS. 3 to 8.

Further, the aligning device 9 is provided at the respective ends of the supporting rail 10. The sliding door 5 can be aligned with respect to the supporting rail 10 by means of this aligning device 9. The aligning device 9 will be described in more detail later in connection with FIGS. 14 to 17.

Figure 3:
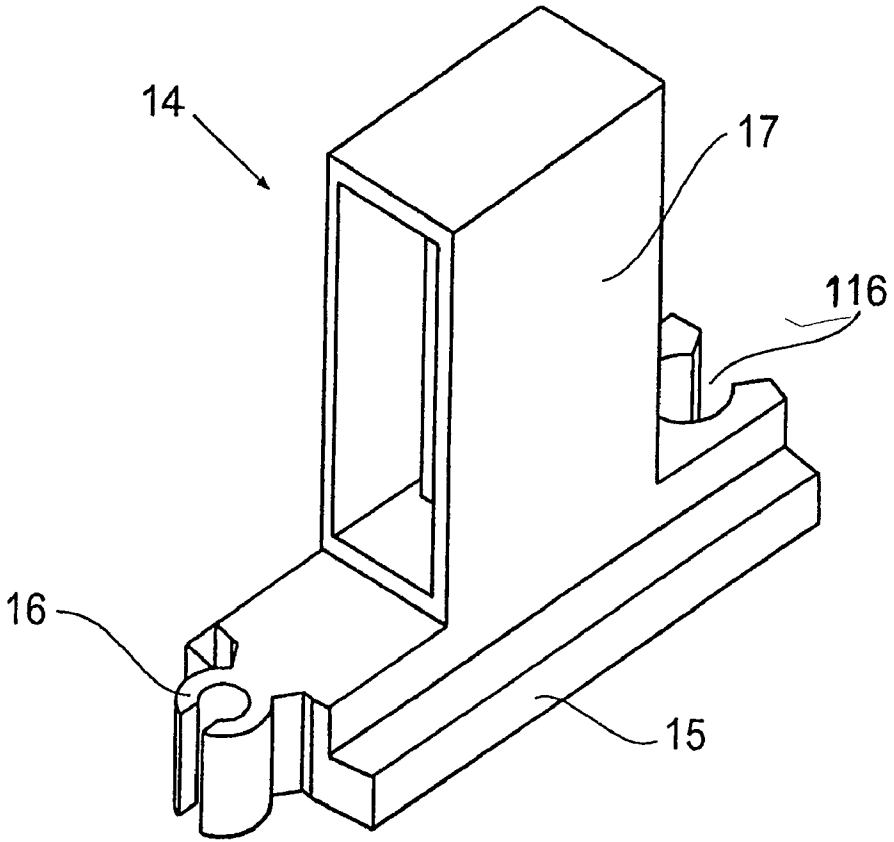
FIG. 3 is a perspective view of a holder used in the guide carriage according to the invention.

The holding member 12 comprises a plurality of individual holders 14. FIG. 3 shows an individual holder 14 of this type. The holder 14 has a base 15 which can be inserted into the C-shaped channel 11 at the supporting rail 10. The base 15 is provided at its front end with a connection element 16 and at its rear end with a connection element 116 which makes it possible to connect a plurality of individual holders 14 to one another in order to form the holding member 12. In the present embodiment example, the connection elements 16 which are constructed in a complementary manner comprise a partially circular locking receptacle 116 at one end and a partially circular locking projection 16 at the other end. The locking projection 16 is inserted into the locking receptacle 116 in such a way that the individual holders 14 are swivelable relative to one another in the plane of the base 15 in order to compensate for tolerances. The connection elements 16 can be inserted in the elements 116 either in vertical direction or in horizontal direction. To enable insertion in the horizontal direction, the connection elements 16 are formed elastically so that the partially circular projection 16 is compressed by a corresponding wedge-shaped insertion ramp at the partially circular locking receptacle 116.

A receptacle 17 serving to support the magnets 13 extends upward from the base 15. The receptacle 17 is shorter than the base 15 so that a space is formed between the individual receptacles 17 when a plurality of holders 14 are joined. Further, each receptacle 17 has two channel-shaped pockets 18 which are arranged on opposite ends of the receptacle 17. The magnets 13 can be inserted into these channel-shaped pockets 18 in such a way that they bridge the distance between two receptacles 17 as is shown in FIG. 2. Vertically extending strips 19 which serve to guide the holders 14 at the inner sides of the slide rails 6 are provided on the outer sides of the receptacles 17. These strips 19 either have a slight air gap relative to the slide rails 6, e.g., 0.1 mm, or contact the slide rails 6 directly without an air gap.

Construction variants of the holder are shown in FIGS. 7 and 8. FIG. 7 shows a holder 14' which is inserted into the supporting rail 10 as an end piece and which, for this reason, is provided with a pocket 18 on only one end, while the end shown in FIG. 7 is planar, i.e., formed without a pocket.

When building the holding member 12, the holder 14' shown in FIG. 7 is first inserted, as initial holder, into the channel 11 of the supporting rail 10. A magnet 13 is then inserted by its front end into the pocket 18 of the first holder 14'. A holder 14 which is shown, e.g., in FIG. 4, is subsequently inserted into the channel 11. In so doing, the pocket 18 facing forward receives the rear end of the first magnet 13. A magnet 13 is now inserted again by its front end into the rear pocket 18 of the next holder 14. This is followed by another holder, and so on, until the supporting rail 10 is completely filled with holders 14 and magnets 13. Finally, a holder 14' according to FIG. 7 is then inserted again into the supporting rail 10. The supporting rail 12 is now in the form shown in FIG. 2.

FIG. 8 shows an entirely different holder 14" in which the base 15 is not shown for reasons of simplicity. This holder 14" has an H-shaped construction as seen from the top and the pockets 18" open upward. Accordingly, all of the holders 14" can be inserted in the supporting rail 10 one behind the other. The magnets 13 are then inserted from above into the pockets 18" of the holders 14" and the pockets 18" are finally closed by a cover 20 (see FIGS. 12 and 13) which preferably covers a plurality of pockets 18" or inserts 22.

Figure 9:
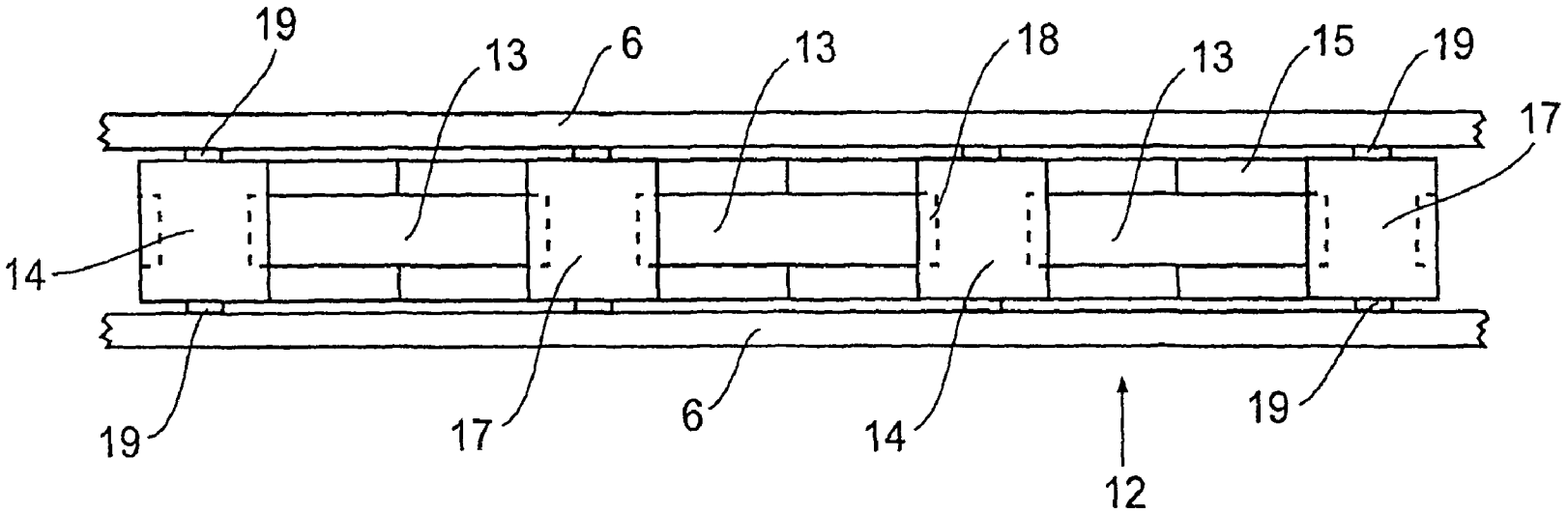
FIG. 9 is a top view of the guide carriage according to FIG. 3.

FIG. 9 is a top view showing the holding member 12 comprising a plurality of holders 14 and magnets 13. It will be seen that the bases 15 contact one another, while the receptacles 17 are spaced apart. This space is bridged by the magnets 13 which rest in the pockets 18 of the receptacles 17. The strips 19 arranged laterally at the receptacles 17 contact the inner sides of the slide rails 6 so as to be substantially free from play and guide the holding member 12 in the slide rails 6.

Figure 10:
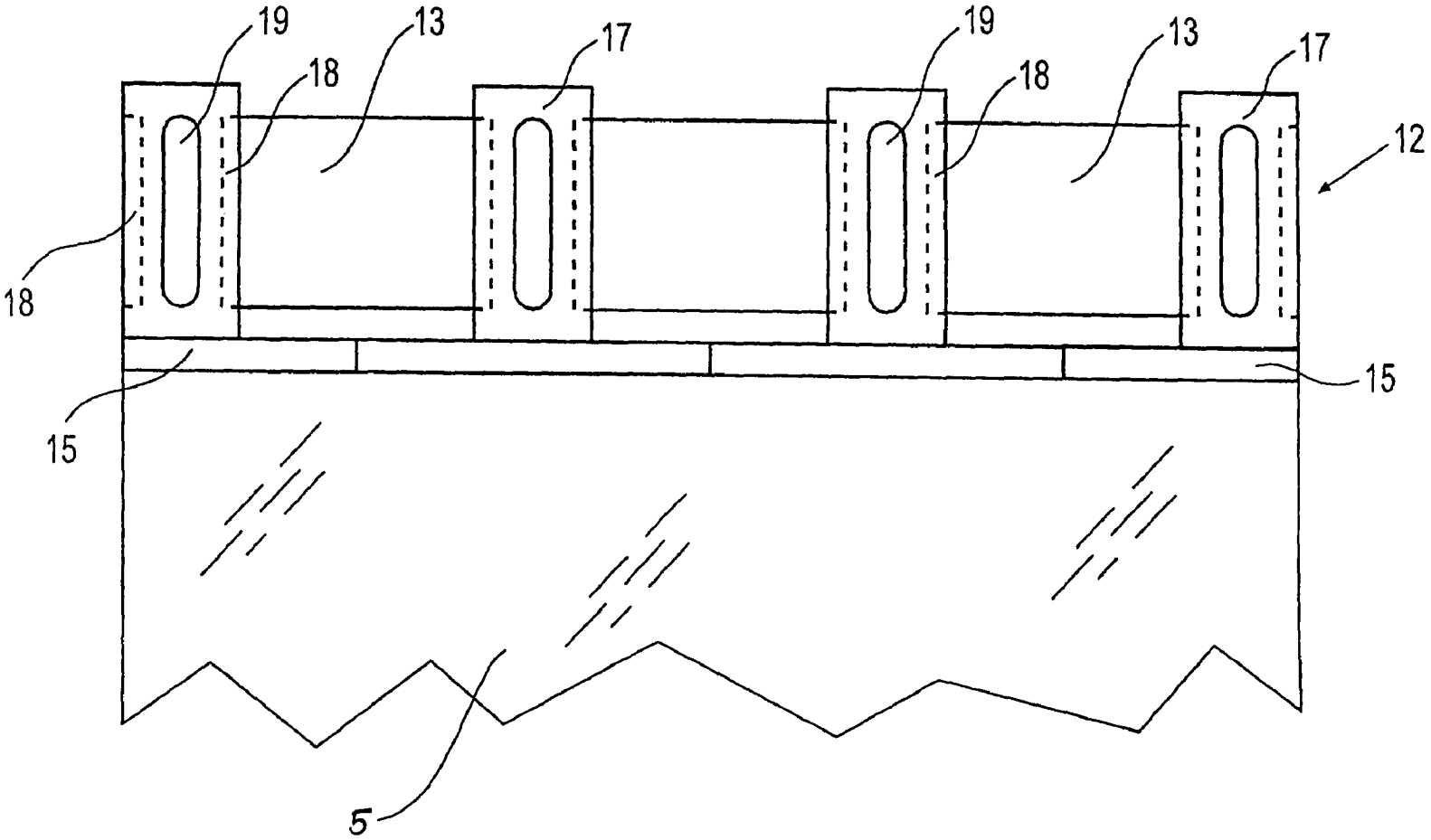
FIG. 10 shows the holder according to FIG. 3 in connection with a sliding door.
Figure 11:
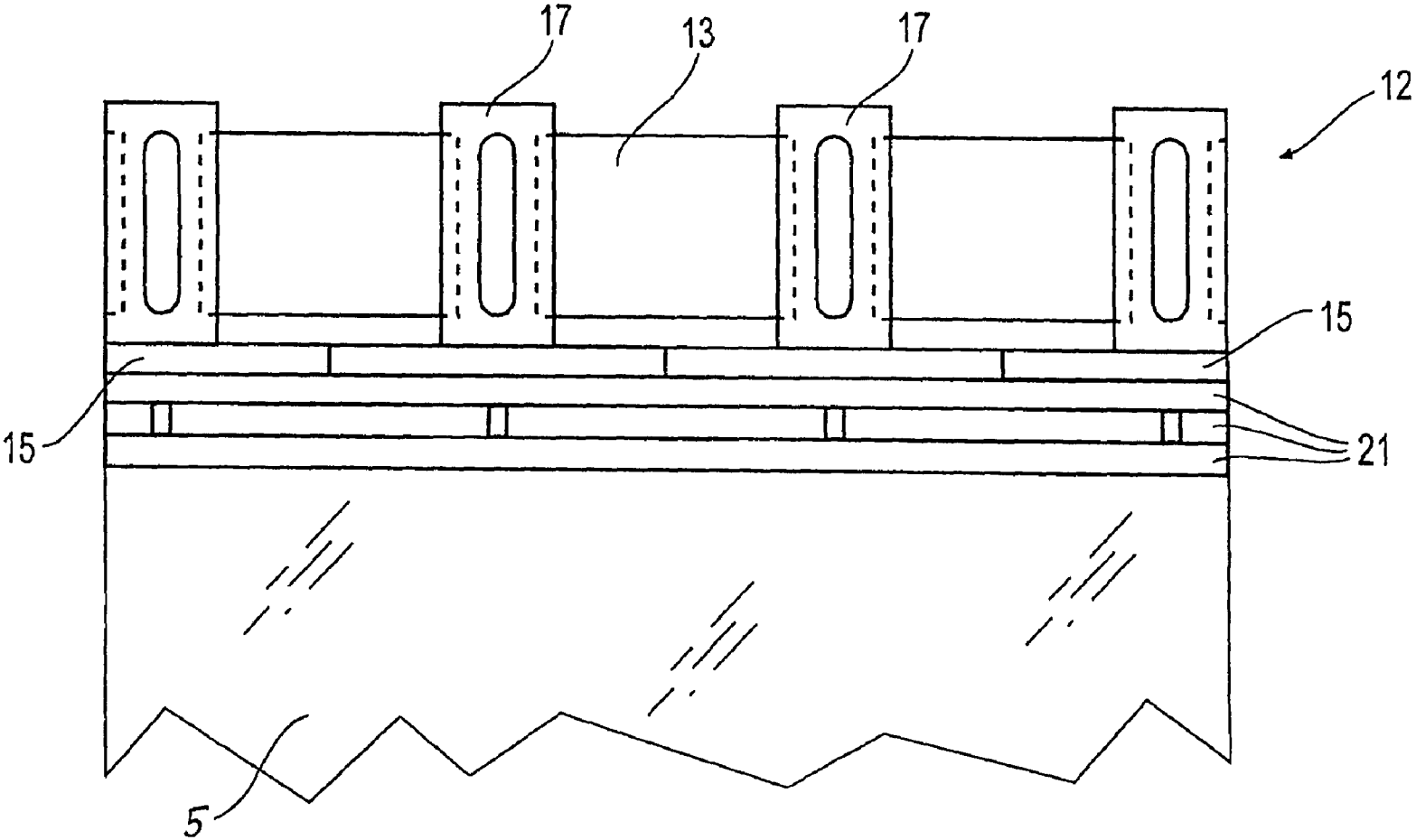
FIG. 11 shows the holder according to FIG. 4 with an additional height adjustment.

FIG. 10 shows a side view of the holding member 12 in connection with the sliding door 5, this holding member 12 comprising a plurality of holders 14 and magnets 13. The holding member 12 is directly connected to the sliding door 5. When height compensation is required, the holding member 12 can also be connected to the sliding door 5 with the intermediary of spacer strips 21 as is shown in FIG. 11.

Figure 12:
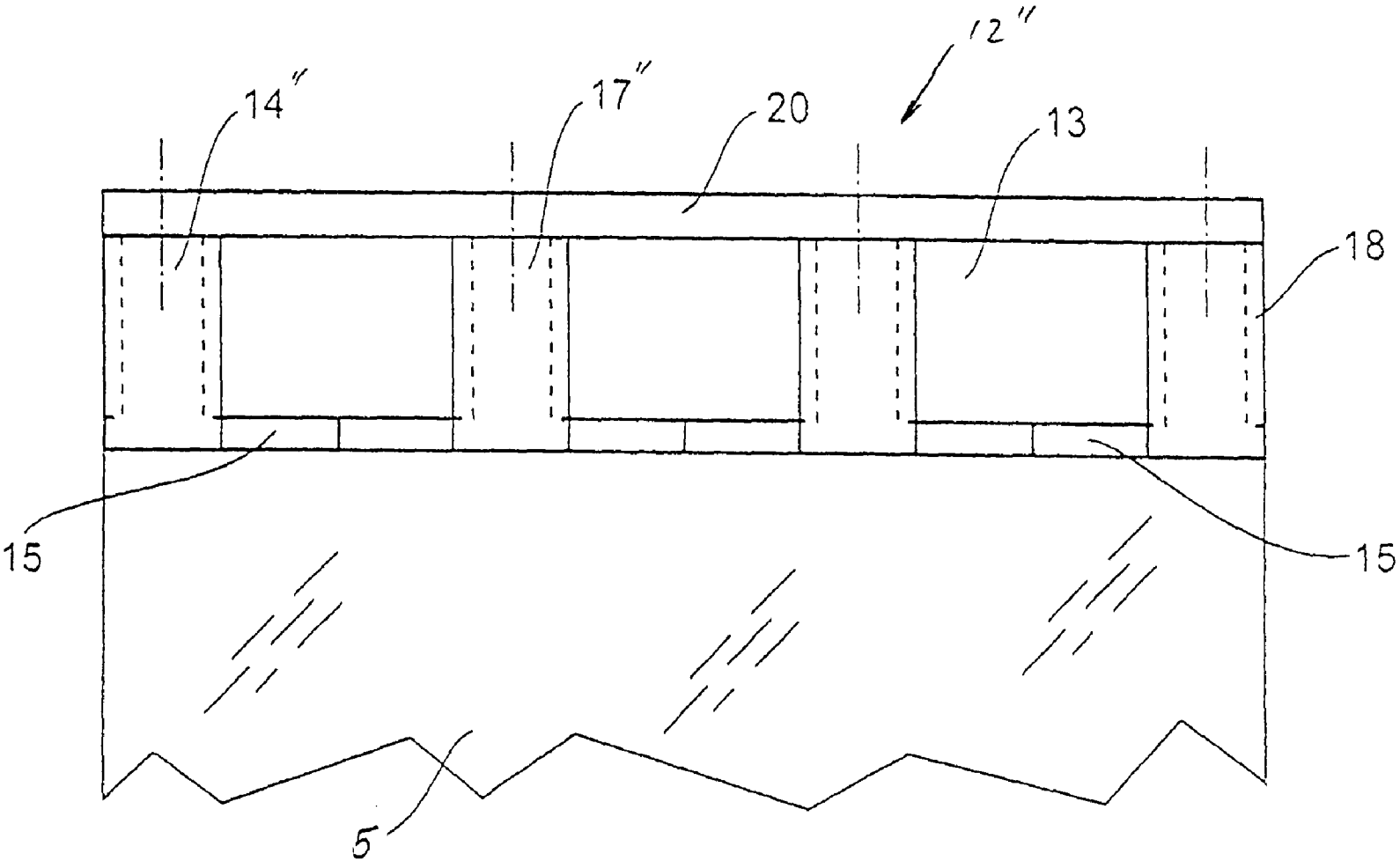
FIG. 12 shows a construction variant of the holder in connection with a sliding door.

FIG. 12 shows a side view of the holding member 12" comprising holders 14" according to FIG. 8 in connection with the sliding door 5. The magnets 13 are inserted into the pockets 18" from above and are secured by the cover 20. The cover 20 is connected to the receptacles 17" by means of connection elements, not shown in detail.

Figure 13:
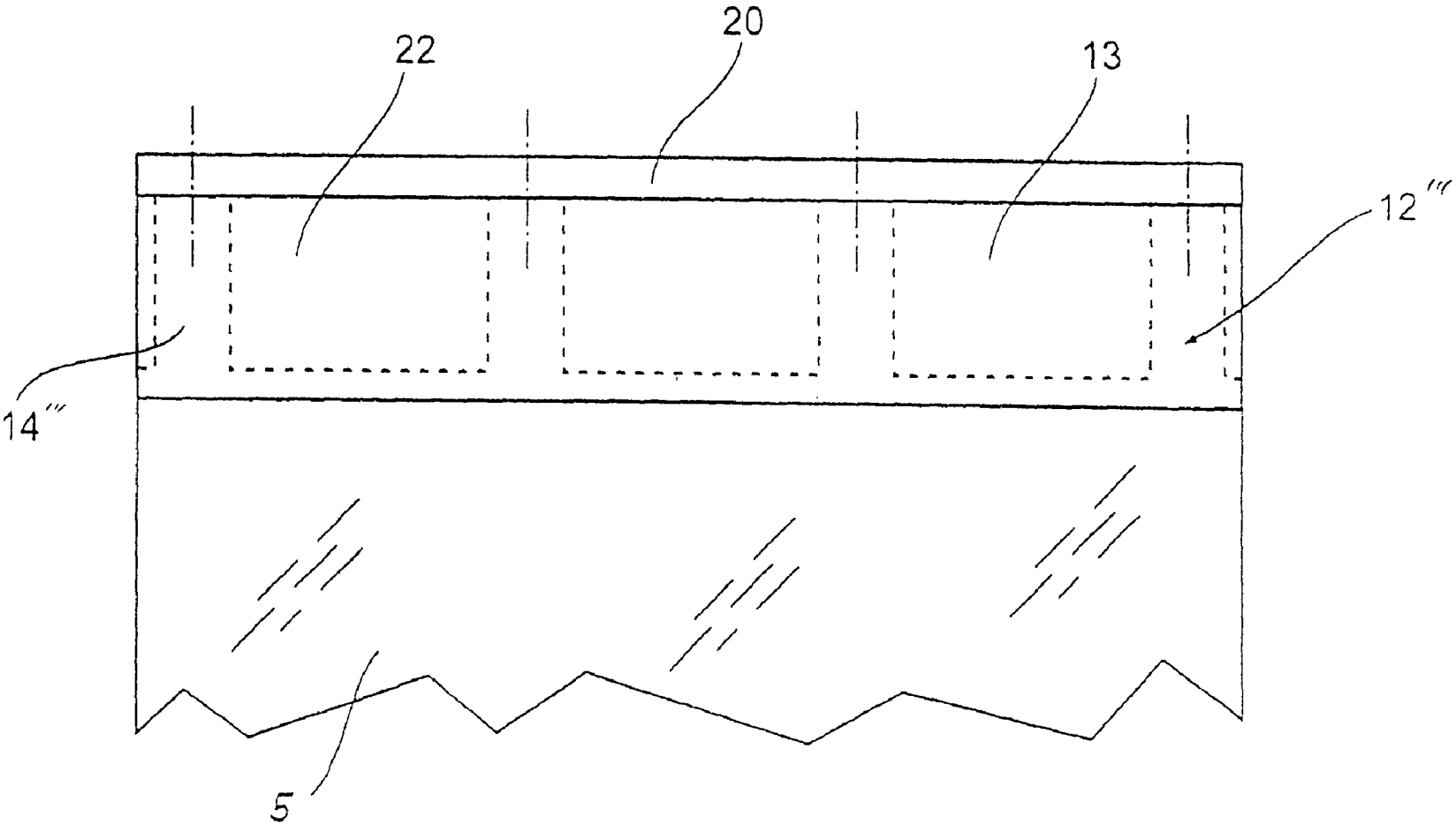
FIG. 13 shows another construction variant of the holder in connection with a sliding door.

FIG. 13 shows a side view of another embodiment form of the holding member 12'" in connection with the sliding door 5. The holding member 12'" shown in this case comprises holders 14'", each of which has a plurality of inserts 22 which open upward and in which the magnets 13 can be inserted. In this case also, the inserts 22 are closed by a cover 20. Another difference with respect to the holders 14, 14" shown in FIGS. 10 to 12 is that the magnets 13 in the holders 14, 14" according to FIGS. 10 to 12 are open toward the side, i.e., toward the slide rails 6, while the magnets 13 in the holder 14"" according to FIG. 13 are also enclosed toward the side by the holder 14"" and side walls of the inserts 22.

FIGS. 14 to 17 show the individual parts of an aligning device 9 which is preferably constructed as an eccentric adjustment and by means of which the sliding door 5 connected to the supporting rail 10 can be aligned. For this purpose, a series of transverse through-holes 23 are arranged in the respective end portions of the supporting rail 10.

Also belonging to the aligning device 9 is a shoe 24 which has two vertically oriented plates 25 making contact with the lateral surfaces of the supporting rail 10 and a horizontally oriented fastening plate 26 connecting the two plates 25 at one of their ends. A number of aligning slots 27 corresponding to the number of through-holes 23 in the supporting rail 10 is provided in the plates 25. The two outer aligning slots 27 are formed as vertically extending elongated holes, while the center aligning slot 27 has a horizontal T shape. A transverse slot 28 in the fastening plate 26 serves to receive a connection element, not shown, for attaching the sliding door 5.

Figure 17:
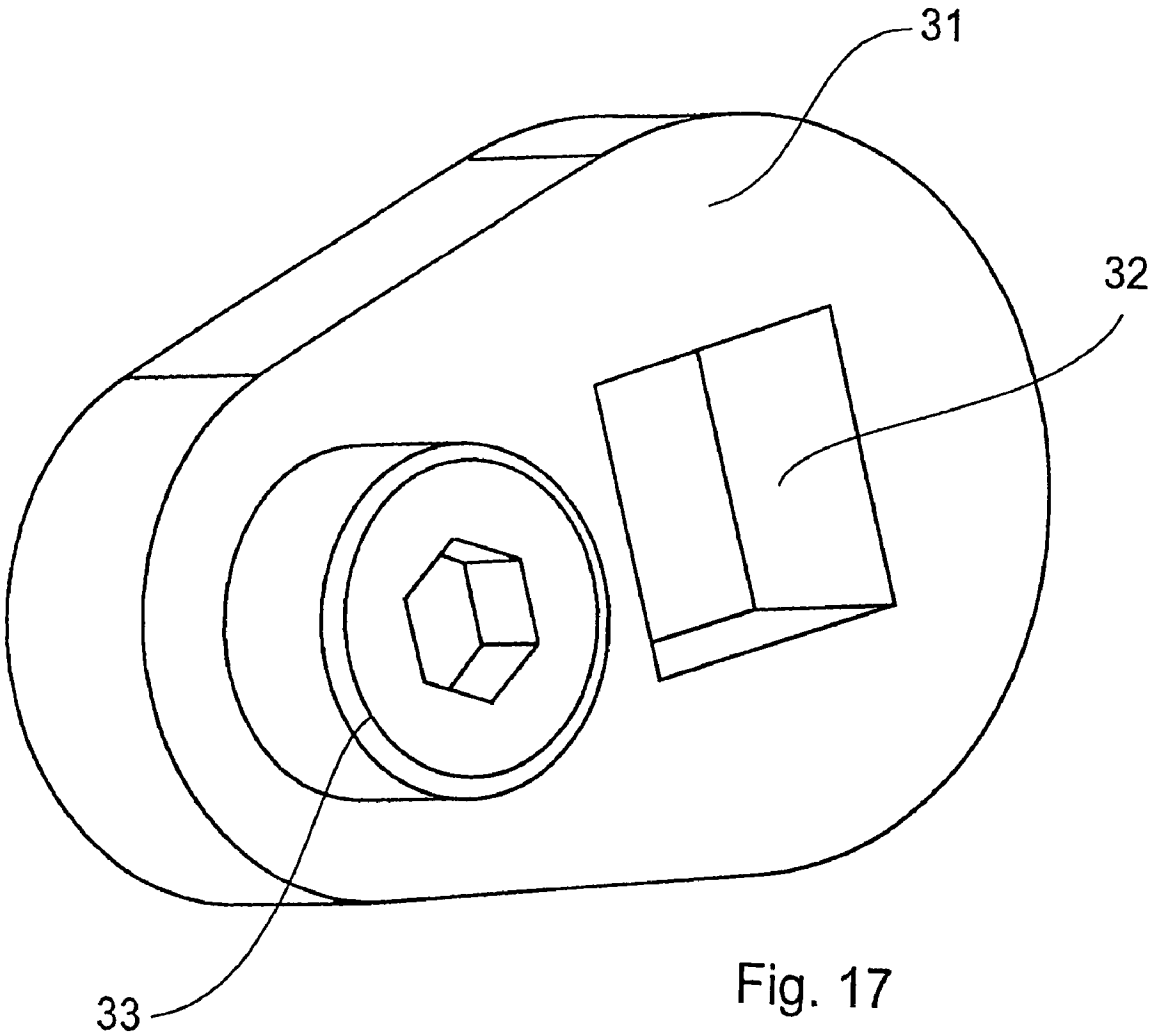
FIG. 17 is a perspective view of a swiveling arm of the first embodiment of the aligning device.

Also belonging to the aligning device 9 is a shaft 29 having a circular cross section in its central area and a square 30 at both ends (see FIG. 16) and a swiveling arm 31 shown in FIG. 17. The swiveling arm 31 has a [receiving] square opening 32 for receiving the square 30 and a cam 33 formed in the present embodiment with a hexagon socket.

The aligning device 9 which comprises the supporting rail 10, the shoe 24, the shaft 29 and the swiveling arm 31 and which is shown in its entirety in FIG. 2 is constructed in the following manner.

The shoe 24 is slid onto the supporting rail 10 in such a way that the through-holes 23 in the supporting rail 10 are aligned with the aligning slots 27. The shaft 29 is then inserted through the center aligning slot 27, formed as a horizontal T, such that it lies in the area of a vertical arm of the T. The squares 30 formed at the two ends of the shaft 29 project beyond the plates 25. A swiveling arm 31 is now inserted on each square 30 and fastened by a retaining screw 34 in such a way that the cam 33 faces inward and engages in the horizontal arm of the horizontal T. Finally, locking bolts 35 are inserted and engage through the two outer aligning slots 27 and the outer through-holes 23.

The relative position of the shoe 24 can now be adjusted with respect to the supporting rail 10 by rotating the shaft 29 and the swiveling arm 31 fastened to the shaft 29, so that the sliding door 5 can be aligned with respect to its position relative to the guide carriage 4. After alignment, the locking bolts 35 are tightened so that the position can no longer be changed once it has been adjusted.

Figure 18:
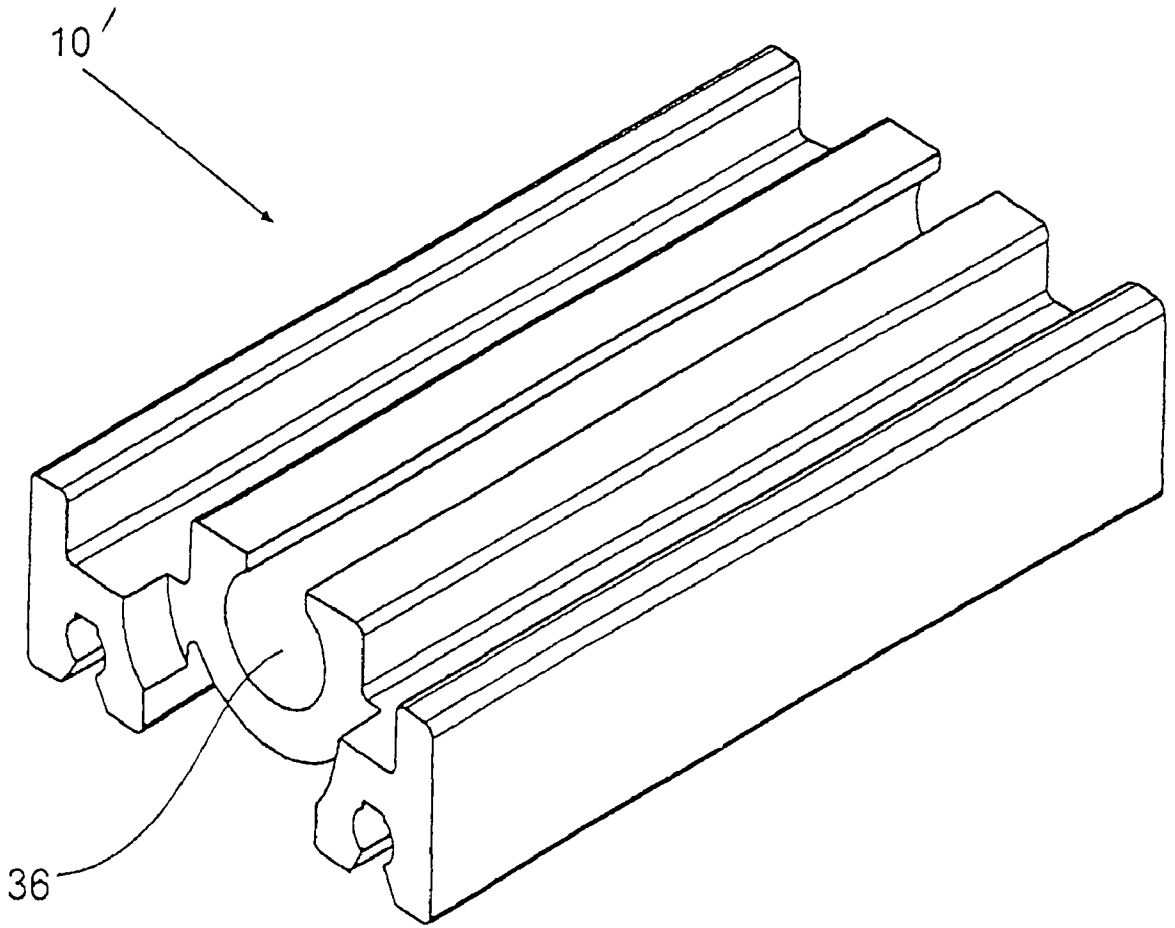
FIG. 18 shows a supporting rail according to another embodiment form used in connection with the linear drive according to the invention.

Another embodiment form of the supporting rail 10' is shown in FIG. 18. This supporting rail 10' has a partially circular longitudinal channel 36 which extends centrally and in which the correspondingly shaped base of the holder 14 can be inserted.

Figure 20:
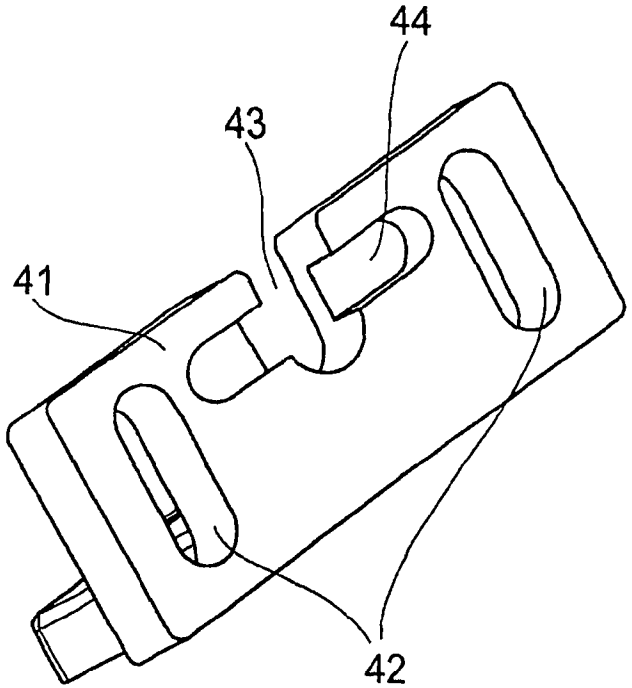
FIG. 20 is another perspective view of the support.
Figure 19:
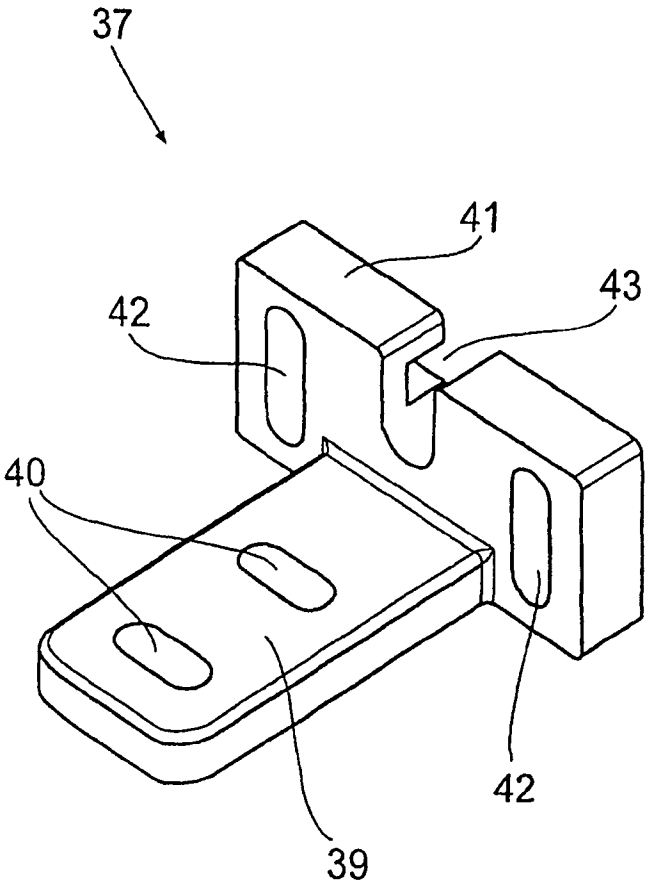
FIG. 19 is a perspective view of a support of a second embodiment of the aligning device.
Figure 21:
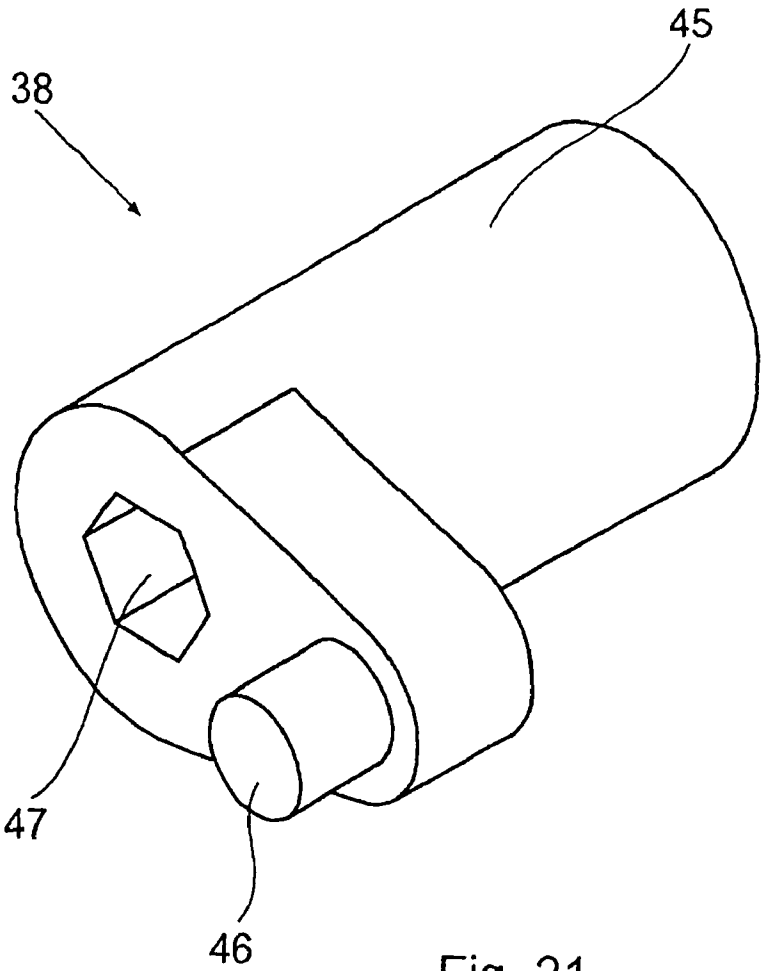
FIG. 21 is a perspective view of a shaft of the second embodiment of the aligning device.

FIGS. 19 to 21 show another embodiment form of the aligning device 9 which is likewise preferably constructed as an eccentric adjustment and which can be used particularly with the supporting rail 10' according to FIG. 18. This aligning device 9 is not arranged laterally at the supporting rail 10' as is the aligning device 9 according to FIGS. 15 to 17, but rather at the side of the supporting rail 10'. The aligning device 9 has an L-shaped angle support 37 that can be arranged at the front side of the supporting rail 10' and an eccentric shaft 38 associated with each angle support 37. A leg 39 of the angle support 37 has two transverse slots 40 which serve to fasten the sliding door 5 arranged at the angle support 37. Another leg 41 of the angle support 37 which is wider than the leg 39 and which projects beyond the sides of the latter has two vertical slots 42 in the projecting area which extend transverse to this leg 41 and which serve to connect to the side of the supporting rail 10'. Further, a vertical slot 43 which opens toward one side is provided in the middle between the two elongated holes 42. On the side remote of the leg 39, a receiving channel 44 extending transverse to the slot 43 and to the slots 42 is arranged in the leg 41 and intersects the slot 43.

The eccentric shaft 38 which also belongs to the aligning device 9 comprises a shaft stub 45, an outwardly projecting cam 46 being arranged at one end of the shaft stub 45 by means of an eccentric arm. An engagement opening 47 which is formed as a hexagon socket in the present embodiment example is provided in the axis of the shaft stub 45 and is serves for adjusting the eccentric shaft 38 by means of a corresponding tool.

The aligning device 9 according to FIGS. 18 to 21 is used in the following manner: The shaft stub 45 of the eccentric shaft 38 is inserted into the longitudinal channel 36 of the supporting rail 10. The angle support 37 is then placed with its leg 41 against the supporting rail 10 in such a way that the cam 46 can engage in the receiving channel 44. In this position, the engagement socket 47 can be reached through the slot 43. In order to align the supporting rail 10 to the sliding door 5, the eccentric shaft 38 is rotated by means of a tool of the like. In so doing, the shaft stub 45 rotates in the longitudinal channel 36 and the cam 46 slides into the receiving channel 44. After alignment, fastening bolts arranged in the slots 42 are tightened.

FIG. 22 shows the coils 7 used in connection with the linear drive 1 according to the invention. The coils 7 are held in coil holders 48. The coil holders 48 are provided with a base plate 49 by which they can be inserted into the C-shaped slide rails 6 (see FIG. 1). Spacers 50 are provided between the coil holders 48 or coils 7 and likewise have a base plate 51 which is insertable into the C-shaped slide rails 6. The spacers 50 are formed with different lengths so that the distances between the coils 7 can be varied. Naturally, the coils 7 and their coil holders 48 can also contact one another directly without the intermediary of spacers 50. Further, connection lugs 52 are provided at the coils 7 for the electrical connection of the latter.

The coils 7 can either be inserted into the coil holders 48 in different positions or, according to an alternative construction, can also be received in the coil holders 48 so as to be rotatable around their axis so that the connection lugs 52 face in different directions depending on the position of the coil 7. In the example shown in FIG. 22, the connection lugs 52 of one coil 7 face to the side, while the connection lugs 52 of the other coil face upward. As a result of this arrangement with connection lugs 52 which are preferably arranged so as to alternate by 90°, it is possible to polarize the coils differently depending upon the position of their connection lugs 52 when attaching the contact rail 8. The ends of all of the connection lugs 52 face in the same direction so that no problems can result when the attaching the contact rail 8.

Figure 23:
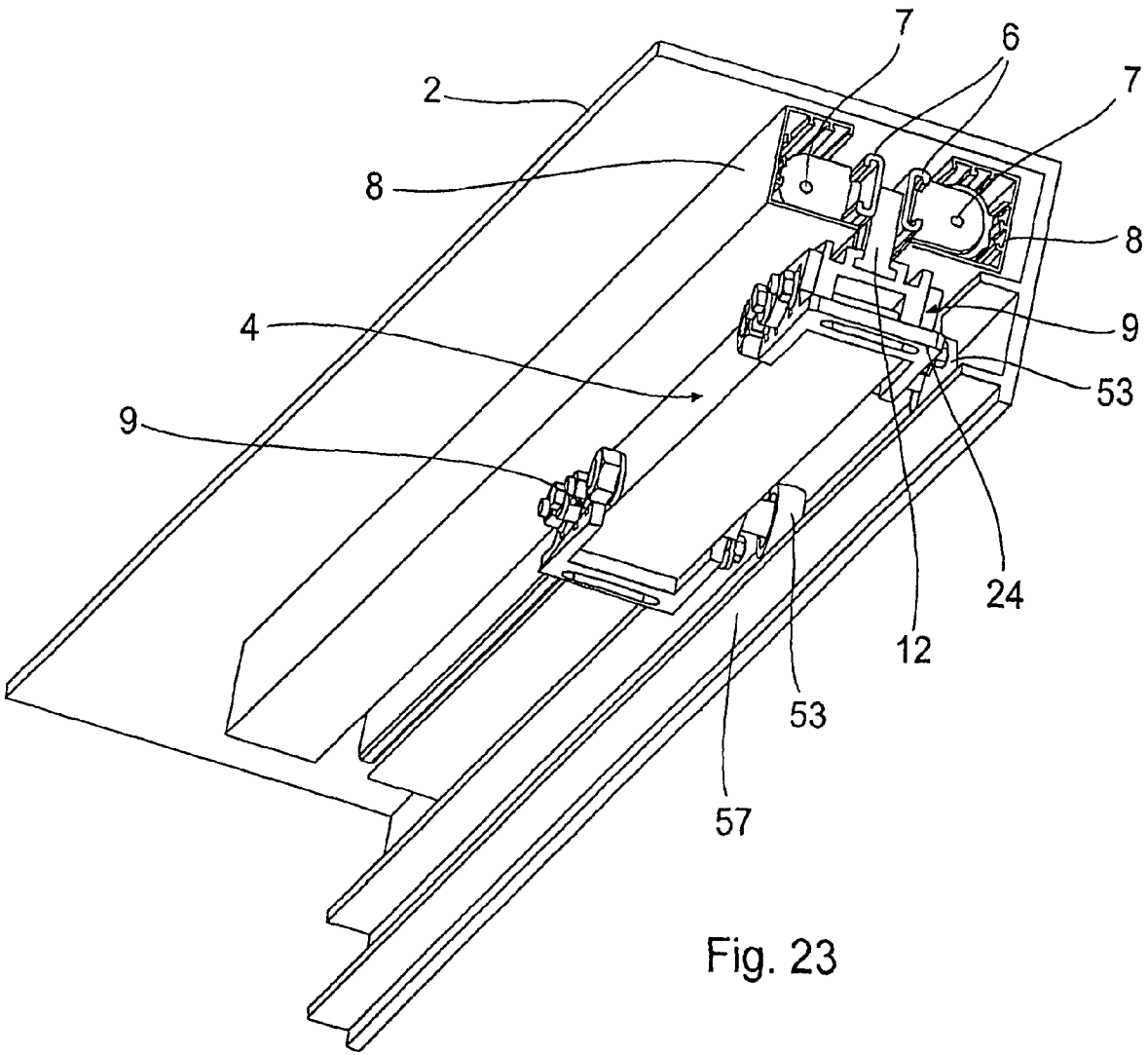
FIG. 23 is a bottom view of the linear drive according to the invention.

FIG. 23 shows the linear drive 1, according to the invention, in the assembled state with only the sliding door 5 arranged at the shoes 24 being omitted for the sake of clarity. It will be seen that the holding member 12 comprising individual holders 14 and magnets 13 is arranged between the two C-shaped slide rails 6 virtually without play. A series of coils 7 is inserted into the slide rails 6 on their outer side and, depending on the position of their connection lugs 52, are connected to the upper or side contact leads arranged in the contact rail 8. The sliding door 5 is held exclusively by the force generated by the coils 7 and the magnets 13 and moves forward or backward depending on the generated magnetic field.

Figure 24:
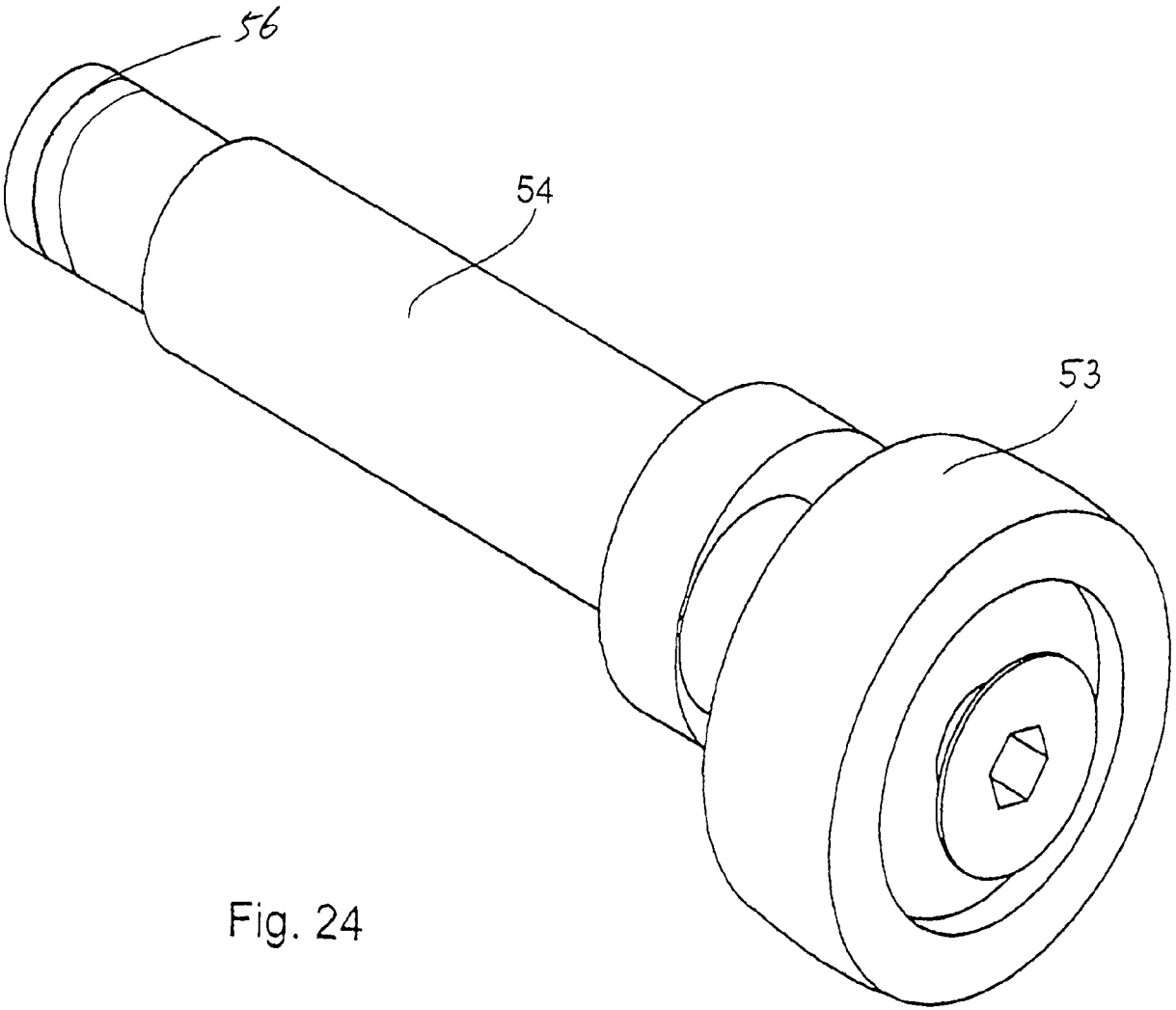
FIG. 24 shows a detail from a sliding door stabilizing arrangement used in connection with the linear drive according to the invention.

It can also be seen from FIG. 23 that a supporting roller 53, shown in detail in FIG. 24, is arranged at the guide carriage 4 in the front area and rear area, respectively. These supporting rollers 53 stabilize the sliding door 5 when starting and braking and accordingly prevent a rocking motion of the sliding door 5. The supporting rollers 53 are each journaled on a bearing shaft 54 which penetrates the supporting rail 10 in a bore hole 55 (see FIG. 14). A freely rotatable roller 53 running on a guide track 57 of the holder 2 is arranged at one end of the bearing shaft 54 eccentric to the shaft axis (see FIG. 23). A thread 56, FIG. 2, serving to receive a fastening nut 59 (see FIG. 2), is arranged at the other end of the bearing shaft 54. The roller 53 is preferably detachably arranged at the bearing shaft 54 so that the roller 53 can be exchanged easily if necessary. The supporting rollers 53 both lie on the same side of the supporting rail 10. Due to the eccentric support of the roller 53 relative to the shaft axis, the roller 53 can be adjusted in its position by rotating the bearing shaft 54 and in this way can be exactly aligned with the guide track 57.

It is not necessary that the supporting rollers 53 roll on the guide track 57 throughout the entire movement of the sliding door 4. Rather, the rollers 53 can also have a slight distance, e.g., of a few tenths of a millimeter, from the guide track 57 because the sliding leaves of the sliding door 5 are suspended in a hovering state by means of the magnetic force of the magnets 13. The hovering state is interrupted during starting and braking by the rocking motion of the sliding door 5. Depending on the selected distance, even a barely perceptible rocking motion can be sufficient to overcome the distance. Accordingly, the rollers 53 would roll on the guide track 57 only in the acceleration phase and braking phase, while they are at a distance from the guide track 57 during the normal movement of the sliding door 5 and accordingly also do not cause any additional friction, since the sliding door 5 is also in a hovering state.

The preceding description of the embodiment examples of the present invention serves for purposes of illustration only and not to limit the invention. Various changes and modifications are possible within the framework of the invention without departing from the scope of the invention and its equivalents.

What is claimed is:

1. A linear drive arrangement for a sliding door, the arrangement comprising:
- a guide track;
- a stator arrangement including coils fixed with respect to said guide track;
- a guide carriage to which a door leaf of the sliding door is fixed, the guide carriage and the door leaf being movable parallel to the guide track, the guide carriage comprising:
  - a front end and a rear end,
  - a pair of opposed sides extending between the front end and the rear end, and
  - two supporting rollers supported at least at times on said guide track, the supporting rollers being disposed respectively at the front and rear ends and on one of said sides of the opposed sides,
  - wherein each of the supporting rollers is journaled on a respective bearing shaft received through a respective bore hole in a body portion of said guide carriage; and
  - a plurality of permanent magnets fixed to said guide carriage, wherein at least a portion of each of the permanent magnets is horizontally co-planar with said coils,
- wherein said permanent magnets and said coils form a holder so that the guide carriage and the door leaf affixed thereto, is suspended at least partially by a magnetic force between said permanent magnets and said coils of said stator arrangement, and
- wherein the permanent magnets and coils form a linear drive for the door leaf so that the guide carriage can be driven along said guide track by said magnetic force.

2. The linear drive arrangement of claim 1, wherein the coils are arranged in two rows and the magnets are positioned between the two rows of the coils.

3. The linear drive arrangement of claim 1, wherein each said bearing shaft has a first end on which said respective supporting roller is journaled eccentrically with respect to the axis of a longitudinal shaft.

4. The linear drive arrangement of claim 3, wherein each said bearing shaft has a threaded second end for receiving a fastening nut.

5. The linear drive arrangement of claim 1, wherein each said supporting roller is detachable from said respective bearing shaft.

6. The linear drive arrangement of claim 1, wherein at least one of the two supporting rollers rolls on the guide track during an entire movement of the guide carriage for preventing the door leaf from rocking relative to the guide track.

7. The linear drive arrangement of claim 1, wherein at least one of the two supporting rollers rolls on the guide track only as movement of the guide carriage begins and ends for preventing the door leaf from rocking relative to the guide track.

8. A linear drive arrangement for a sliding door, the arrangement comprising:
- a guide track;
- a stator arrangement comprising a plurality of coils fixed to said guide track;
- a guide carriage carrying a door leaf of the sliding door and movable parallel to said guide track, said guide carriage comprising:
  - a front end and a rear end,
  - a pair of opposed sides extending between the front end and the rear end, and
  - two supporting rollers supported at least at times on said guide track, the supporting rollers being disposed respectively at the front and rear ends and on one of said sides of the opposed sides, wherein each of the supporting rollers is journaled on a respective bearing shaft received through a respective bore hole in a body portion of said guide carriage; and a plurality of permanent magnets fixed to said guide carriage, at least a portion of each of said permanent magnets being horizontally co-planar with said coils, and said permanent magnets and said coils being operable to generate a magnetic force which at least partially suspends the guide carriage and linearly drives the guide carriage along said guide track.

9. The linear drive arrangement of claim 8, wherein each said bearing shaft has a first end on which said respective supporting roller is journaled eccentrically with respect to a longitudinal axis of the shaft.

10. The linear drive arrangement of claim 9, wherein each said bearing shaft has a threaded second end for receiving a fastening nut.

11. The linear drive arrangement of claim 8, wherein each of the supporting rollers is detachable from said respective bearing shaft.

12. The linear drive arrangement of claim 8, wherein at least one of the two supporting rollers rolls on the guide track during the entire movement of the guide carriage for preventing the door leaf from rocking relative to the guide track.

13. The linear drive arrangement of claim 8, wherein at least one of the two supporting rollers rolls on the guide track only as movement of the guide carriage begins and ends for preventing the door leaf from rocking relative to the guide track.

14. The linear drive arrangement of claim 8, wherein the coils are arranged in two rows and the magnets are positioned between the two rows of the coils.

15. A linear drive arrangement for a door leaf of a sliding door, the arrangement comprising:

a guide track;

a stator arrangement including coils fixed with respect to said guide track;

a guide carriage to which the door leaf is fixed, the guide carriage being moveable parallel to the guide track;

a plurality of permanent magnets fixed to said guide carriage, at least a portion of each of the plurality of permanent magnets being horizontally co-planar with said coils, and wherein the guide carriage and the door leaf are suspended at least partially by a magnetic force between said magnets and said coils, and wherein the magnets and coils form a linear drive so that the guide carriage and the door leaf can be driven along said guide track by said magnetic force; and at least one supporting roller supporting said guide carriage on said guide track when said carriage is not fully suspended by said magnetic force.

* * * * *